United States Patent [19]

Sofy

[11] Patent Number: 4,852,381

[45] Date of Patent: Aug. 1, 1989

[54] TRANSFER MECHANISM FOR PUNCH PRESSES

[76] Inventor: Hugh M. Sofy, 201 Warrington Dr., Bloomfield Hills, Mich. 48013

[21] Appl. No.: 199,431

[22] Filed: May 31, 1988

[51] Int. Cl.[4] ..... B21J 13/08

[52] U.S. Cl. ..... 72/405; 72/421

[58] Field of Search ..... 72/405, 421; 198/621; 100/216

[56] References Cited

U.S. PATENT DOCUMENTS

| | | | |
|---|---|---|---|
| 3,011,464 | 12/1961 | Danly et al. | 72/405 |
| 3,105,399 | 10/1963 | Strugala et al. | 72/405 |
| 3,411,636 | 11/1968 | Wallis | 198/621 |
| 3,422,657 | 1/1969 | Grombka et al. | 72/405 |
| 4,311,429 | 1/1982 | Wallis | 72/421 |

*Primary Examiner*—Daniel C. Crane

*Attorney, Agent, or Firm*—Reising, Ethington, Barnard, Perry & Milton

[57] ABSTRACT

A transfer assembly (10) for carrying workpieces (W) to subsequent forming stations in a punch press (12) is disclosed. The reciprocation of a press ram (14) actuates a plate cam (50) having a curvilinear slot (52) disposed therein to arcuately displace a rocker arm (34). The rocker arm (34) linearly drives an input rack (42) having a series of gear teeth extending therealong. The gear teeth of the input rack (42) engage and rotate an input gear (44) integrally connected to an output gear (46) having a pitch circle diameter larger than that of the input gear (44). An output rack (40) having a plurality of gear teeth extending therealong engages the output gear (46) for moving a workpiece engaging jaw (18) longitudinally of the work stations a greater distance than the input rack (42) is moved.

13 Claims, 5 Drawing Sheets

TRANSFER MECHANISM FOR PUNCH PRESSES

TECHNICAL FIELD

The subject invention relates to a workpiece transfer assembly for automatically moving individual workpieces through a progressive die punch press.

BACKGROUND ART

Transfer assemblies for automatically moving individual workpiece's to subsequent die stations in a progressive die punch press forming machine are well known in the art. Typically, these prior art transfer assemblies include some form of engagement means for individually engaging the workpieces in their respective stations and then individually carrying the workpieces to the subsequent stations. One common and efficient method of driving the engagement means as it carries the workpieces to the next forming station is by a rocker arm type mechanism. That is, the engagement means is mechanically linked to the free swinging end of a rocker arm and displaced longitudinally of the forming stations as the rocker arm sweeps an arcuate path.

Examples of mechanical transfer assemblies having rocker arm mechanisms responsive to the press ram for moving the engagement means longitudinally of the die stations are shown in the U.S. Pat. No. 3,155,241 to Suofy, issued Nov. 3, 1964; U.S. Pat. No. 3,421,637 to Sofy, issued Jan 14, 1969; U.S. Pat. No. 4,198,854 to Sofy, issued Apr. 22, 1980; U.S. Pat. No. 4,436,199 to Baba et al, issued Mar. 13, 1984; and U.S. Pat. No. 4,513,602 to Sofy, issued Apr. 30, 1985.

The prior art transfer assemblies including engagement means moved by a rocker arm mechanism which is responsive to the press ram, such as those referenced above, are deficient in that the maximum obtainable indexing movement, i.e., movement equal to the distance between adjacent progressive die stations, is completely dependent upon the length of the rocker arm used and/or the degree of actuate oscillation thereof. Consequently, if the distance between adjacent die stations is very long, a long rocker arm is required to provide the necessary displacement or an average length rocker arm must sweep an unusually large arcuate path. Quite often it is impractical to provide a long rocker arm when attempting to achieve a long indexing movement due to the physical space limitations about the press. Similarly, a large arcuate sweep may be impossible due to the same space limitations about the press. Additionally, operating rocker arms and especially long rocker arms sweeping a large arcuate path present a danger to persons nearby unless adequately guarded with costly protective equipment. Further, as the length of a rocker arm increases, the greater, and more deleterious, the effect of resistance at the free swinging end becomes due to the leverage created. Similarly, as the degree of the arcuate path swept by the rocker arm increases, the mechanical advantage of the rocker arm, at certain positions, will decrease below an acceptable limit.

SUMMARY OF THE INVENTION AND ADVANTAGES

The subject invention provides a transfer assembly for moving workpieces through a series of in-line equidistant progressive forming stations in a press of the type including a reciprocating forming member. The transfer assembly comprises engagement means for engaging the workpieces in the respective stations and moving the workpieces longitudinally an indexing output distance to subsequent stations and then disengaging the workpieces for workpiece forming. The transfer assembly also comprises drive means responsive to the forming member of the press to be moved thereby a predetermined input distance thereby for displacing the engagement means longitudinally of the stations. The subject invention is characterized by including motion multiplier means disposed between the drive means and the engagement means for displacing the engagement means the output distance which is a different distance from the predetermined input distance.

The subject invention overcomes the defficiencies in the prior art by including motion multiplier means which can effectively move the engagement means large indexing output distances even when used on a punch press which would otherwise present physical space limitations on the drive means. Also, the subject invention improves the safety of the prior art transfer assemblies by eliminating the need for large moving parts in the drive means capable of injuring persons. Further, the mechanical advantage of the drive means may be isolated to an optimum range for moving the engagement means without chance of malfunction due to insufficient mechanical advantage.

BRIEF DESCRIPTION OF THE DRAWINGS

Other advantages of the present invention will be readily appreciated as the same becomes better understood by reference to the following detailed description when considered in connection with the accompanying drawings wherein.

Figure 3:
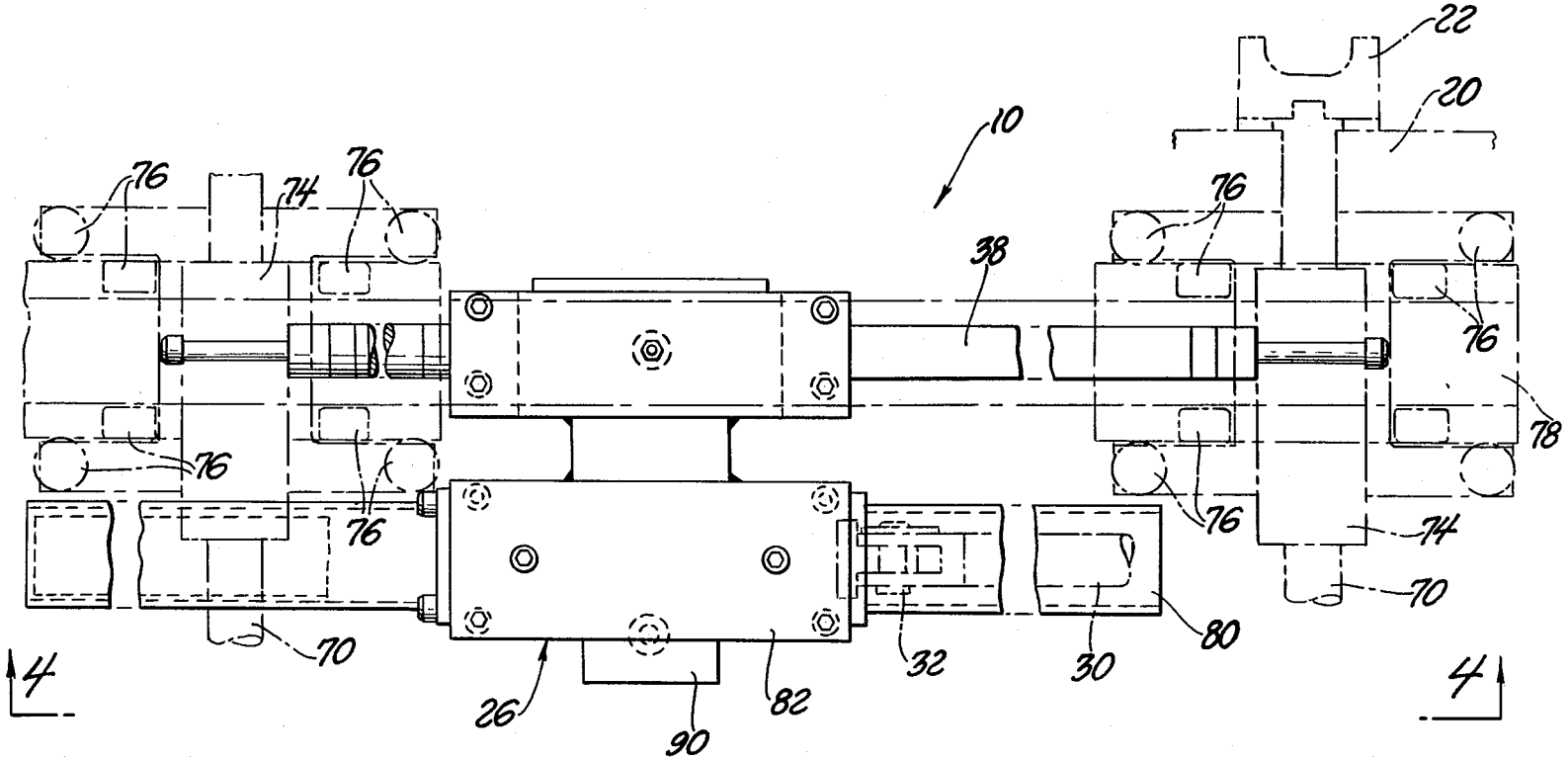
Figure 4:
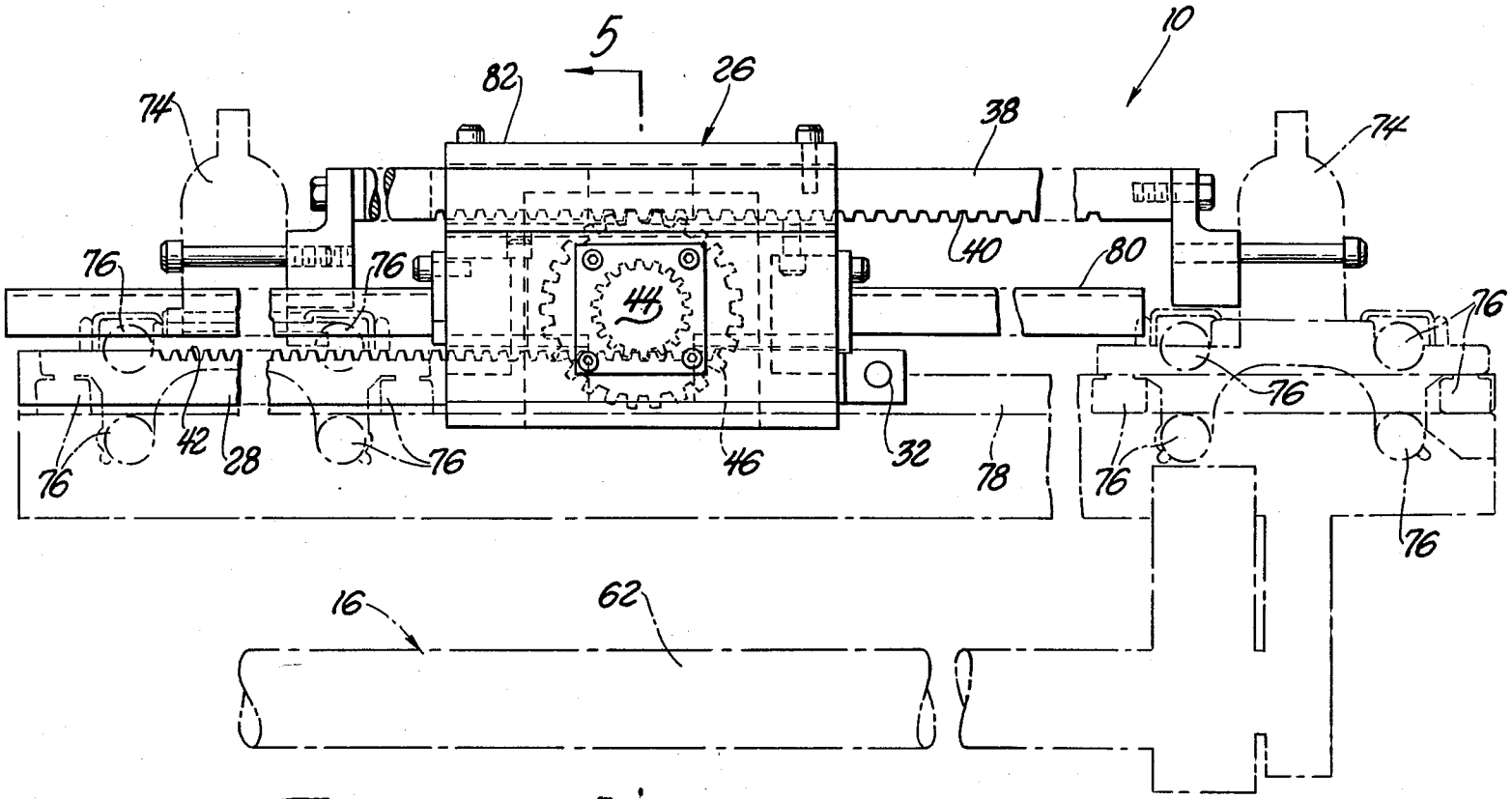
Figure 5:
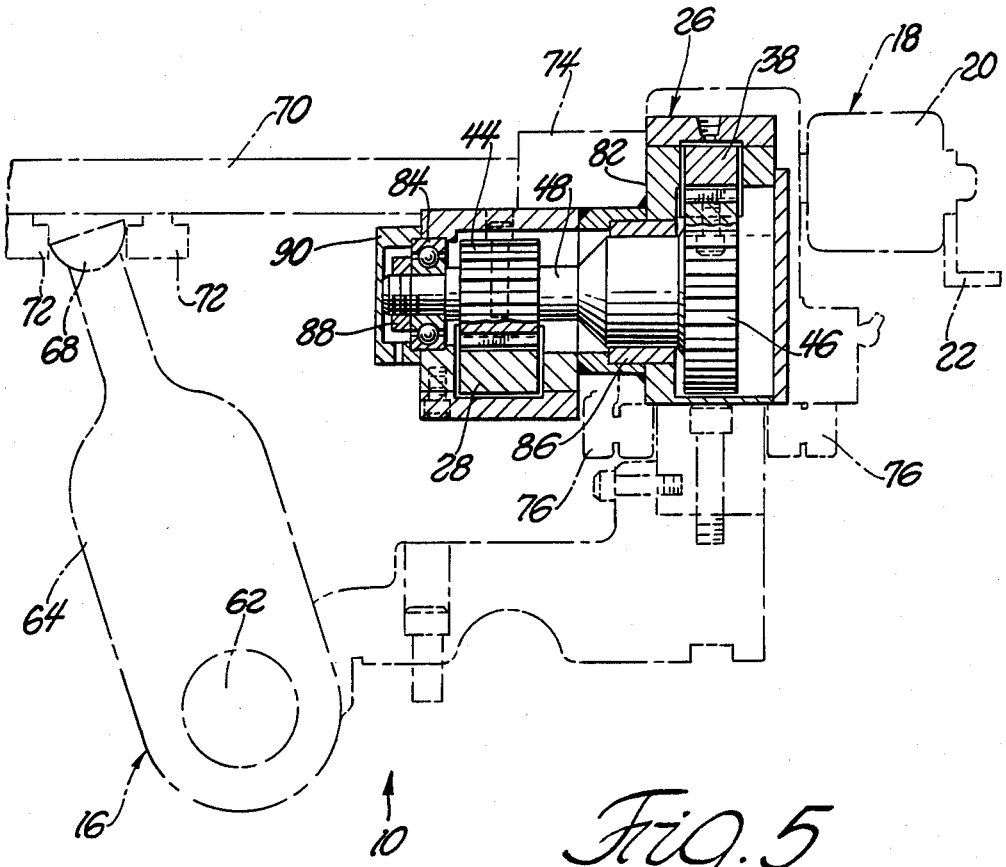

Figure is a top view of the subject invention;

FIG. 4 is an end view of the subject invention taken substantially along line 4—4 of FIG. 3; and FIG. 5 is a cross sectional view of the subject invention taken substantially along line 5—5 of FIG. 4.

DETAILED DESCRIPTION OF THE PREFERRED EMBODIMENT

Referring to the FIGURES, wherein like numerals indicate like or corresponding parts throughout the several views, a workpiece transfer assembly is generally shown at 10. The transfer assembly 10 is adapted for automatically moving a plurality of workpieces W through a series of inline equidistant progressive forming stations in a press, generally indicated at 12 in FIG. 1. The press 12 is of the type which includes a reciprocating forming member, or ram, 14 cyclically moveable toward and away from, i.e., up and down relative to, the forming die stations.

The transfer assembly 10 includes engagement means, generally indicated at 16, for individually engaging the workpieces W in the respective stations and moving the workpieces W longitudinally an indexing output distance to subsequent stations and then disengaging the workpieces W for workpiece forming. That is, the indexing output distance of the transfer assembly 10 equals the distance between the adjacent forming die stations, such that the engagement means 16 individually carries each workpiece W from one die station to the next for progressive forming.

Figure 1:
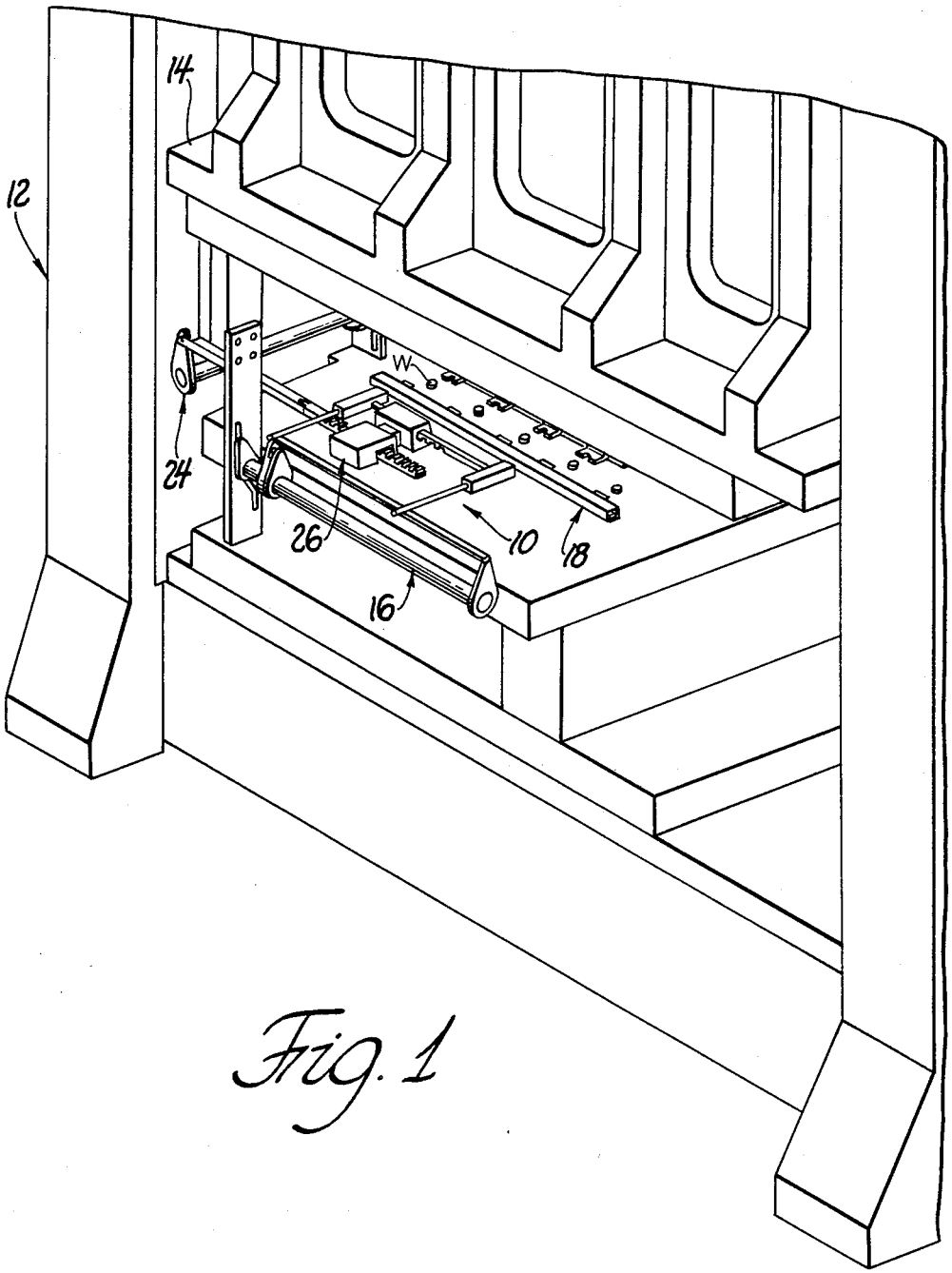
FIG. 1 is a perspective view showing a transfer assembly of the subject invention mounted for operation in a punch press.
Figure 2:
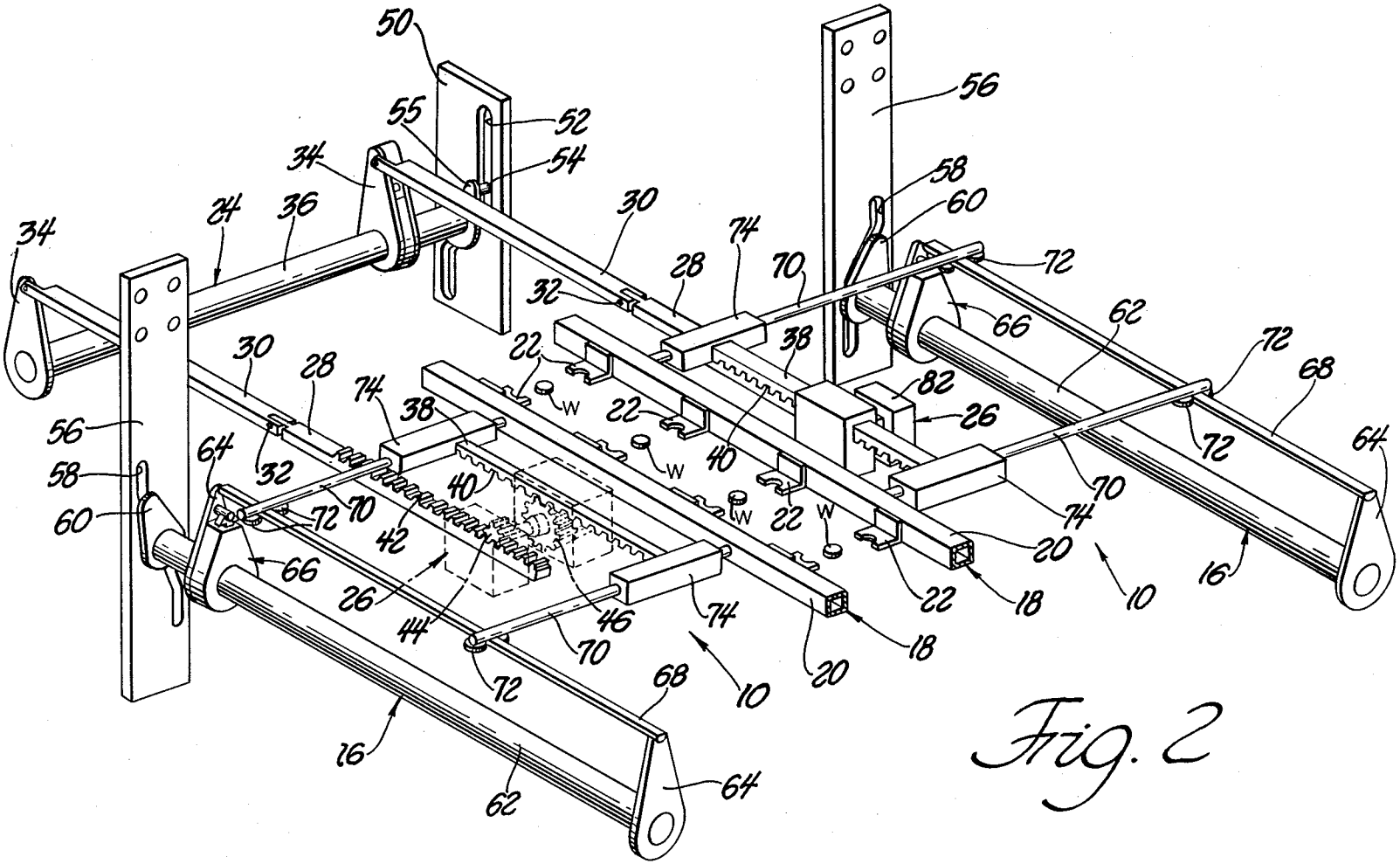
FIG. 2 is a perspective view of a preferred embodiment of the subject invention.

The engagement means 16 includes a workpiece engaging jaw, generally indicated at 18 in FIGS. 1 and 2, which is moveable toward and away from the workpieces W in their respective stations. More specifically, the jaw 18 includes a tubular transfer bar 20 and a plurality of fingers 22 disposed therealong positionally corresponding to the die stations. The fingers 22 are shaped to engage the workpieces W as the transfer bar 20 is moved toward the workpieces and to transport or carry the workpieces W as the transfer bar 20 is moved longitudinally of the die stations.

According to the preferred embodiment of the subject invention, as shown in FIGS. 1 and 2, one transfer assembly 10 of the subject invention is disposed on each of the two flanks of the press 12 for use in tandem during the workpiece W transfer operation. In this manner, the jaw 18 of each of the two engagement means 16 of the two transfer assemblies 10 engage the workpieces W from opposite sides for greater stability during transfer from one die station to the next.

The subject transfer assembly 10 also includes drive means, generally indicated at 24 in Figures 1 and 2, which is responsive to the movement of the ram 14 of the press 12. The drive means 24, then, is moved by the ram 14 a predetermined input distance for ultimately displacing the engagement means 16 longitudinally of the stations. Therefore, the movement of the ram 14 actuates the drive means 24 to move the predetermined input distance, which then displaces the engagement means 16 the indexing output distance for individually transferring the workpieces W for one die station to the next.

The subject transfer assembly 10 is characterized by including motion multiplier means, generally indicated at 26 in FIGS. 1–5, which is disposed between the drive means 24 and the engagement means 16 for displacing the engagement means 16 the output distance which is a different distance from the predetermined input distance. Or, said another way, the motion multiplier means 26, upon receiving the input motion from the drive means 24, transforms this motion into the indexing output distance for moving the engagement means 16 a distance equal to the distance between adjacent progressive die stations. By multiplying the input distance from the drive means 24 by a factor greater than or less than 1.0, the motion multiplier means 26 efficiently displaces the engagement means 16 the required output distance, for reasons which will be addressed subsequently.

As shown in FIG. 2, the drive means 24 includes a linearly moving input element 28 drivingly connected to the motion multiplier means 26. An input rack 42 is disposed along a portion of the input element 28 which includes a series of gear teeth extending therealong. The input element 28 is connected to a drive link 30 by a pinned hinge connection 32. The end of the drive link 30 distal the connection 32 is pivotally connected to the free swinging end of a rocker arm 34. The rocker arm 34 is disposed on a rock shaft 36 and driven to oscillate about a longitudinal axis of the rock shaft 36 by the ram 14. In this manner, as the free end of the rocker arm 34 sweeps an arcuate path about the longitudinal axis of the rock shaft 36, the attached drive link 30 urges the input element 28 to linearly move the predetermined input distance.

As shown in FIG. 2, the engagement means 16 includes a linearly moving output element 38 drivingly connected to the motion multiplier means 26. More specifically, as shown in FIGS. 2 and 4, the output element 38 of the engagement means 16 includes an output rack 40 having a series of gear teeth extending therealong, for reasons to be addressed presently.

The motion multiplier means 26 includes a circular input gear 44 having a predetermined pitch circle diameter, a circular output gear 46 having a predetermined pitch circle diameter, and gear train means 46 for transmitting motion from the input gear 44 to the output gear 46, as best shown in FIGS. 2, 4 and 5. As shown in FIG. 5, the gear train means 48 includes a shaft 48 extending axially from the input gear 44 to the output gear 46. In this manner, the input gear 44 directly drives the output gear 46 during operation. Gear teeth are evenly distributed about both the input gear 44 and the output gear 46.

The gear teeth extending along the input rack 42 engage the gear teeth disposed about the input gear 44 so that as the input element 28 is moved the predetermined input distance in response to the movement of the ram 14, the input gear 44 is rotated. Similarly, the gear teeth disposed about the output gear 46 engage, or mesh with, the gear teeth extending along the output rack 46 for driving the output element 38 the requisite indexing output distance. Therefore, it will be appreciated that the motion multiplier means 26 is a completely mechanical system moving the engagement means 16 mechanically in response to the movement of the drive means 24.

The drive means 24 further includes a linearly reciprocating plate cam 50 which reciprocates with the movement of the ram 14, as best shown in FIG. 2. The cam 50 has a curvilinear slot 52 disposed therein for arcuately displacing a cam engaging element 54 disposed on a follower arm 55 which drives the rock shaft 36.

As shown in FIGS. 1 and 2, the input element 28 of the drive means 24 and the output element 38 of the engagement means 16 extend longitudinally of the die stations. That is to say, the input element 28 and the output element 38 are moved parallel of the die stations.

In the preferred embodiment illustrated in FIGS. 1 and 2, the engagement means 16 is responsive to the movement of the press ram 14 for cyclically moving the jaw 18 toward and away from the workpieces W. More specifically, a reciprocating engagement cam 56 is attached to the ram 14 and includes a curvilinear slot 58 disposed therein for arcuately displacing a cam engaging element (not shown) at the free swinging end of an engagement follower arm 60. Thus, the engagement follower arm 60 is induced to oscillate in an arcuate path as the engagement cam 56 reciprocates with the press ram 14. The oscillation of the engagement follower arm 60 causes an engagement rock shaft 62 to oscillate within fixed bearings (not shown), which in turn urges two engagement rocker arms 64 to sweep an arcuate path thereabout. A safety clutch mechanism, generally indicated at 66, may be provided for disengaging the engagement rocker arm 64 from the engagement rock shaft 62 in the event of workpiece jam or obstruction, as is well known in the art. A crank bar 68 extends between the free swinging ends of the engagement rocker arms 64 for arcuate movement therewith.

Referring to FIG. 2, two motion transmitting tubes 70 are connected to the crank bar 68 by roller elements 72 disposed on each side of the crank bar 78. The motion transmitting tubes 70 extend perpendicularly inwardly from the crank bar 68 and are longitudinally spaced from each other. The roller elements 72 allow unrestricted movement of the motion transmitting tubes 70 along the crank bar 68. A linear guide bearing 74 is disposed on each of the two ends of the output element 38. The two motion transmitting tubes 70 extend, one each, through the two guide bearings 74 for guided lateral movement toward and away from the die stations.

The transfer bar 20 of the jaw 18 is fixedly attached to the ends of the motion transmitting tubes 70 adjacent the die stations. Therefore, as the engagement cam 56 is reciprocated with the ram 14, the engagement rock shaft 62 urges the engagement rocker arms 64 to oscillate back and forth, thus moving the crank bar 68 in an arcuate path, which motion is transferred to the motion transmitting tubes 70 and ultimately moves jaw 18 toward and away from the workpieces W in the die stations. It will be appreciated that the timed movement of the jaw 18 toward and away from the workpieces W is predetermined for synchronization with the movement of the press ram 14 and drive means 24.

As shown in FIG. 3, the engagement means 16 is supported for allowing unrestricted longitudinal movement in response to the movement of the drive means 24. More particularly, a plurality of trolley wheels 76 are mounted for movement with the output element 38. The trolley wheels 76 surround and tangentially contact a fixed guide member 78 extending longitudinally of the die stations. Therefore, as the drive means 24 moves the engagement means 16 the output distance, the trolley wheels 76 ensure smooth and precise movement as they are guided along the guide member 78.

In FIGS. 3 and 4, a U-shaped protective shield 80 is shown rigidly disposed over a portion of the input element 28 for preventing an operator's hands or personal effects from contacting the gear teeth of the input rack 42 and otherwise being drawn into the motion multiplier means 26.

In FIG. 5, the axial shaft 48 of the motion multiplier means 26, which extends between the input gear 44 and output gear 46, is shown supported in a housing 82 between a roller bearing 84 adjacent the input gear 44 and a sliding bearing 86 adjacent the output gear 46. The axial shaft 48 has an enlarged diameter portion adjacent the output gear 46. A retainer nut 88 is threaded on the end of the shaft 48 adjacent the roller bearing 84 for retaining the shaft 48, and more particularly the input 44 and the output 46 gears, in proper alignment. A safety cap 90 is disposed over the nut 88.

The diameter of the input gear 44 pitch circle is different from the diameter of the output gear 46 pitch circle. As shown in FIGS. 4 and 5, the input gear 44 is smaller than the output gear 46. More specifically, the pitch circle diameter of the output gear 46 is approximately twice the diameter of the input gear 44 pitch circle. In this manner, a 2:1 ratio is provided in that the output element 38 will be displaced twice the distance which the input element 28 moves. For example, if the input element 28 is moved 10 inches, the jaw 18 will be moved 20 inches. It will be appreciated, however, that any output ratio may be provided by proper selection of input 44 and output 46 gear pitch circle diameters.

OPERATION OF THE PREFERRED EMBODIMENT

As the press ram 14 closes upon the workpieces W in their die stations, the two jaws 18 are in a retracted position, away from the workpieces W, to prevent damage of the fingers 22 or the transfer bars 20 by the ram 14. After the ram 14 has fully closed upon, and thus formed, the workpieces W, the ram 14 begins to move upwardly, away from the die stations and workpieces W. The attached cams 56 first move upwardly with the ram 14 to urge the engagement follower arms 60 of the two engagement means 16 to rotate as their cam engaging elements are displaced within the curvilinear slots 58. With this, the engagement rocker arms 64 rotate the crank bars 68 toward the die stations, thus urging the motion transmitting tubes 70 and the attached jaws 18 toward the workpieces W. As the jaws 18 of the engagement means 16 are in the process of moving toward the workpieces W, the drive means 24 remains in a dwell, i.e., motionless, state. A moment after the fingers 22 on the jaws 18 engage the respective workpieces, the cam engaging element 54 of the drive follower arm 55 is displaced within the curvilinear slot 52 of the cam 50. This urges the two rocker arms 34 to sweep an arcuate path about the longitudinal axis of the rock shaft 36, thus moving the drive links 30 and the attached input elements 28. The input rack 42 of the input elements 28 in turn rotate the input gears 44 of the two motion multiplier means 26, and finally displace the output elements 38 thus moving the jaws 18 with the engaged workpieces W longitudinally to their respective subsequent die stations.

Once the output elements 38 have been displaced the requisite indexing output distance, the drive means 24 and the engagement means 16 remain in a state of dwell, i.e., motionlessness, while the ram 14 of the press 12 reaches the uppermost position in its stroke.

As the ram 14 then begins to descend upon the workpieces W, the engagement follower arms 60 are urged to retrace their path within the curvilinear slots 58 of the engagement cams 56, to retract the jaws 18 from the workpieces W in their respective new die stations. While jaws 18 are moving away from the workpieces W, the drive means 24 again remains in a dwell state. Once the jaws 18 have been fully retracted from the workpieces W, the curvilinear slots 52 in the cams 50 urge the drive follower arms 55 to oppositely rotate the rocker arms 34 about the longitudinal axes of the rock shafts 36. As the ram 14 continues its descent upon the workpieces W, the drive means 24 retracts the engagement means 16 to the initial starting position, ready for another cycle.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A transfer assembly (10) for moving workpieces (W) through a series of in-line equidistant progressive forming stations in a press (12) of the type including a reciprocating forming member (14), said assembly (10) comprising: engagement means (16) for engaging the workpieces (W) in the respective stations and moving the workpieces (W) longitudinally an indexing output distance to subsequent stations and then disengaging the workpieces (W) for workpiece forming; drive means (24) responsive to the movement of the forming member (14) of the press (12) to be moved thereby a predetermined input distance for displacing said engagement means (16) longitudinally of the stations; said drive means (24) including an input element (28), a rock shaft (36) having a longitudinal axis, a rocker arm (34) disposed on said rock shaft (36) for oscillation about said longitudinal axis of said rock shaft (36) in response to movement of the forming member (14) and having a free end distal said longitudinal axis of said rock shaft (36) connected to said input element (28), said free end connected to said input element (28) being at a fixed length from said longitudinal axis of said rock shaft (36); said assembly (10) characterized by including motion multiplier means (26) drivingly connected to said input element (28) and disposed between said input element (28) and said engagement means (16) for displacing said engagement means (16) said output distance which is a different distance from said predetermined input distance.

2. An assembly (10) as set forth in claim 1 further characterized by said motion multiplier means (26) moving said engagement means (16) mechanically in response to the movement of said drive means (24).

3. An assembly (10) as set forth in claim 2 further characterized by said engagement means (16) including a linearly moving output element (38) drivingly connected to said motion multiplier means (26).

4. An assembly (10) as set forth in claim 3 further characterized by said motion multiplier means (26) including a circular input gear (44) having a predetermined pitch circle diameter engaging said input element (28), a circular output gear (46) having a predetermined pitch circle diameter engaging said output element (38), and gear train means (48) for transmitting motion from said input gear (44) to said output gear (46).

5. An assembly (10) as set forth in claim 4 further characterized by the diameter of said input gear (44) pitch circle being different than the diameter of said output gear (46) pitch circle.

6. An assembly (10) as set forth in claim 5 further characterized by said gear train means (48) including a shaft extending axially from said input gear (44) to said output gear (46).

7. An assembly (10) as set forth in claim 6 further characterized by said input element (28) of said drive means (24) including an input rack (42) having a series of gear teeth extending therealong for engaging a corresponding series of gear teeth disposed about said input gear (44).

8. An assembly (10) as set forth in claim 7 further characterized by said output element (38) of said engagement means (16) including an output rack (40) having a series of gear teeth extending therealong for engaging a corresponding series of gear teeth disposed about said output gear (46).

9. An assembly (10) as set forth in claim 8 further characterized by said drive means (24) including a drive link (30) extending from said free end of said rocker arm (34) to said input element (28).

10. An assembly (10) as set forth in claim 9 further characterized by said drive means (24) including a linearly reciprocating plate cam (50) responsive to the forming member (14) having a curvilinear slot (52) disposed therein for receiving and arcuately displacing a cam engaging element (52) disposed on a follower arm (55) for oscillating said rock shaft (36).

11. An assembly (10) as set forth in claim 10 further characterized by said input element (28) of said drive means (24) and said output element (38) of said engagement means (16) extending longitudinally of the stations.

12. A transfer assembly (10) for moving workpieces (W) through a series of in-line equidistant progressive forming stations in a press (12) of the type including a reciprocating forming member (14), said assembly (10) comprising: a plate cam (50) for linear reciprocation having a curvilinear slot (52) disposed therein responsive to the movement of the forming member (14) of the press (12); a rock shaft (36) having a central longitudinal axis and supported for oscillation about said longitudinal axis; a follower arm (55) fixedly disposed on said rock shaft (36) and having a cam engaging element (54) disposed in said curvilinear slot (52) of said cam (50); a rocker arm (34) disposed on said rock shaft (36) and driven to arcuately oscillate by said rock shaft (34); an input rack (42) linearly moved by said rocker arm (36) and having a series of gear teeth disposed therealong; an input gear (44) having a series of gear teeth disposed thereabout in communication with said gear teeth on said input rack (42); an output gear (46) having a series of gear teeth disposed thereabout; a shaft (48) extending axially from said input gear (44) to said output gear (46); a linearly moving output rack (40) having a series of gear teeth extending therealong in communication with said gear teeth on said output rack (40); and a workpiece engaging jaw (18) driven longitudinally of the stations by said output rack (40) for engaging the workpieces (W) in the respective stations and moving the workpieces (W) longitudinally to subsequent stations and then disengaging the workpieces (W) for workpiece forming.

13. A method for moving workpieces (W) through a series of in-line equidistant progressive forming stations in a press (12) of the type including a reciprocating forming member (14), said method including the steps of: engaging the workpieces (W) in the respective stations with a workpiece engaging jaw (18); oscillating a rocker arm (34) about an axis in response to the movement of with said input element (28) being connected on said rocker arm (34) at a fixed length from said axis distance to subsequent stations; and disengaging the workpieces (W) for workpiece forming; said method characterized by multiplying the movement of the input distance to displace the workpiece engaging jaw (18) the indexing output distance which is different than the input distance.

* * * * *